US011473788B2

(12) United States Patent
Kitabatake et al.

(10) Patent No.: US 11,473,788 B2
(45) Date of Patent: Oct. 18, 2022

(54) OUTDOOR UNIT OF AIR-CONDITIONING APPARATUS AND METHOD OF ASSEMBLING OUTDOOR UNIT OF AIR-CONDITIONING APPARATUS

(71) Applicant: Mitsubishi Electric Corporation, Tokyo (JP)

(72) Inventors: Yo Kitabatake, Tokyo (JP); Shigeru Hata, Tokyo (JP); Keiichi Tomita, Tokyo (JP); Yohei Kawaguchi, Tokyo (JP); Rei Hayakawa, Tokyo (JP); Kento Oku, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 698 days.

(21) Appl. No.: 16/339,890

(22) PCT Filed: Dec. 21, 2016

(86) PCT No.: PCT/JP2016/088175
§ 371 (c)(1),
(2) Date: Apr. 5, 2019

(87) PCT Pub. No.: WO2018/116421
PCT Pub. Date: Jun. 28, 2018

(65) Prior Publication Data

US 2020/0041145 A1 Feb. 6, 2020

(51) Int. Cl.
*F24F 1/12* (2011.01)
*F24F 1/40* (2011.01)
(Continued)

(52) U.S. Cl.
CPC ..... *F24F 1/12* (2013.01); *F24F 1/40* (2013.01); *F24F 1/56* (2013.01); *F24F 13/24* (2013.01);
(Continued)

(58) Field of Classification Search
CPC ..... F24F 1/12; F24F 1/40; F24F 1/56; F24F 13/24; F24F 2013/202; F25B 2500/12
(Continued)

(56) References Cited

U.S. PATENT DOCUMENTS

2005/0056481 A1 3/2005 Mafi et al.

FOREIGN PATENT DOCUMENTS

CN 204853729 U 12/2015
JP 11159813 A * 6/1999
(Continued)

OTHER PUBLICATIONS

Office Action dated Jun. 30, 2020 issued in corresponding CN patent application No. 201680091575.6 (and English translation).
(Continued)

*Primary Examiner* — Steve S Tanenbaum
(74) *Attorney, Agent, or Firm* — Posz Law Group, PLC

(57) ABSTRACT

An outdoor unit of an air-conditioning apparatus enabling a soundproof material to correctly cover a compressor and having enhanced assembling efficiency and a method for assembling the outdoor unit of an air-conditioning apparatus are provided. The outdoor unit of an air-conditioning apparatus includes the compressor installed inside a casing and the soundproof material covering at least the compressor. The soundproof material includes a lower soundproof material surrounding a lateral periphery of a lower portion of the compressor and an upper soundproof material surrounding a lateral periphery of an upper portion of the compressor.

17 Claims, 3 Drawing Sheets

(51) Int. Cl.

| | |
|---|---|
| ***F24F 1/56*** | (2011.01) |
| ***F24F 13/24*** | (2006.01) |
| ***F24F 13/20*** | (2006.01) |

(52) U.S. Cl.
CPC ..... *F24F 2013/202* (2013.01); *F25B 2500/12* (2013.01)

(58) Field of Classification Search
USPC ..... 181/202
See application file for complete search history.

(56) References Cited

FOREIGN PATENT DOCUMENTS

| | | | |
|---|---|---|---|
| JP | H11-159813 | A | 6/1999 |
| JP | 2009-156141 | A | 7/2009 |
| JP | 2013-053771 | A | 3/2013 |
| JP | 2013-088003 | A | 5/2013 |
| JP | 2015-135104 | A | 7/2015 |

OTHER PUBLICATIONS

International Search Report of the International Searching Authority dated Mar. 21, 2017 for the corresponding International application No. PCT/JP2016/088175 (and English translation).
Decision of Rejection dated May 12, 2021, issued in corresponding CN Patent Application No. 201680091575.6 (and English Machine Translation).
Chinese Office Action dated Dec. 21, 2020, issued in corresponding CN Patent Application No. 201680091575.6 (and English Machine Translation).

* cited by examiner

OUTDOOR UNIT OF AIR-CONDITIONING APPARATUS AND METHOD OF ASSEMBLING OUTDOOR UNIT OF AIR-CONDITIONING APPARATUS

CROSS REFERENCE TO RELATED APPLICATION

This application is a U.S. national stage application of PCT/JP2016/088175 filed on Dec. 21, 2016, the contents of which are incorporated herein by reference.

TECHNICAL FIELD

The present invention relates to an outdoor unit of an air-conditioning apparatus, and more particularly, to a soundproof structure for a compressor installed inside an outdoor unit of an air-conditioning apparatus, and a method for assembling the outdoor unit.

BACKGROUND ART

A compressor is mounted in a conventional outdoor unit of an air-conditioning apparatus to compress refrigerant and circulate the refrigerant in a refrigerant circuit. In an outdoor unit of an air-conditioning apparatus, noise generated from a compressor during operation is large and operating noise leaked to the outside of the outdoor unit may cause a noise problem. To solve the problem, in many models, a soundproof material is attached to cover the compressor. The soundproof material has a band-like shape and includes a sound absorption layer on the inner side and single or multiple sound insulation layers on the outer side. Then, the soundproof material is wrapped around a lateral face of the compressor and thereby covers the compressor.

The soundproof material is configured in such a manner that a sound insulation layer forming an outer part is longer than a sound absorption layer forming an inner part of the soundproof material. In other words, the sound insulation layer projects farther than an end portion of the sound absorption layer at one end portion of the soundproof material. Also, end portions of the sound absorption layer of the soundproof material wrapped around the compressor face and are in contact with each other. For preventing noise leakage during operation of the compressor, an external face of a gap opened in the part in which the end portions of the sound absorption layer face and are in contact with each other is covered by the sound insulation layer projecting farther than one end portion of the sound absorption layer. A hook-and-loop fastener provided on the projecting part of the sound insulation layer can be secured to a hook-and-loop fastener provided on an external face of the other end portion of the soundproof material. Consequently, the soundproof material covers a lateral face of the compressor in such a manner that soundproof material is rolled in a tubular shape (see, for example, Patent Literature 1).

CITATION LIST

Patent Literature

Patent Literature 1: Japanese Unexamined Patent Application Publication No. 2009-156141 (pages 1 to 7, FIG. 3)

SUMMARY OF INVENTION

Technical Problem

Connecting a refrigerant pipe to be connected to a compressor in an outdoor unit of an air-conditioning apparatus with the compressor covered by the soundproof material according to Patent Literature 1 causes the problem of the soundproof material being burned by brazing. For prevention of burning of the soundproof material due to brazing, it is necessary to attach the soundproof material to the compressor after brazing of the compressor and the refrigerant pipe to each other. Also, in this case, as the refrigerant pipe and other components are disposed around the compressor, to be attached, the soundproof material has to be inserted a space between the refrigerant pipe and each of the other components in a lateral direction of the compressor. Consequently, the soundproof material sits on the compressor leg portions that fix the compressor to the casing of the outdoor unit, resulting in a failure to fully cover the entire compressor. Furthermore, as attachment of refrigerant circuit components such as the refrigerant pipe is done, even when the attachment of the soundproof material is insufficient, it is difficult to visually confirm whether the soundproof material sits on the compressor leg portions, in particular, for the rear of the compressor. Consequently, operating noise of the compressor leaks from the gap thus opened, which may cause a noise problem. Also, the structure of the soundproof material in Patent Literature 1 has a problem in that when the soundproof material is inserted in the lateral direction of the compressor to be attached, the other refrigerant circuit components are obstacles to the work of the attachment.

The present invention has been made to solve the aforementioned problems, and a first object of the present invention is to provide an outdoor unit of an air-conditioning apparatus that is less likely to cause leakage of noise to the outside of the outdoor unit because the soundproof material sits on the compressor leg portions when the soundproof material is attached to the compressor and a method for assembling the outdoor unit of an air-conditioning apparatus.

Also, a second object of the present invention is to provide an outdoor unit of an air-conditioning apparatus in which a part in which end portions of a sound absorption layer forming the inner side of a soundproof material face and are in contact with each other is covered by a sound insulation layer for soundproof effect enhancement with the first object achieved and a method for assembling the outdoor unit of an air-conditioning apparatus.

Also, a third object of the present invention is to provide an outdoor unit of an air-conditioning apparatus having assembling efficiency enhanced by improving attachment workability in inserting a soundproof material in a lateral direction to cover a compressor and a method for assembling the outdoor unit of an air-conditioning apparatus.

Solution to Problem

An outdoor unit of an air-conditioning apparatus according to one embodiment of the present invention includes a compressor installed inside a casing, and a soundproof material covering at least the compressor. The soundproof material includes a lower soundproof material surrounding a lateral periphery of a lower portion of the compressor, and an upper soundproof material surrounding a lateral periphery of an upper portion of the compressor.

A method of assembling an outdoor unit of an air-conditioning apparatus according to another embodiment of the present invention includes a lower soundproof material attachment step of surrounding a periphery of a lower portion of a compressor installed inside a casing by a lower soundproof material and fixing the lower soundproof material, a pipe joining step of joining a pipe connection portion positioned at an upper portion of the compressor and a pipe included in a refrigerant circuit, and an upper soundproof material attachment step of surrounding a periphery of the upper portion of the compressor by an upper soundproof material and fixing the upper soundproof material. The pipe joining step is performed after the lower soundproof material attachment step, and the upper soundproof material attachment step is performed after the pipe joining step.

Advantageous Effects of Invention

The outdoor unit of an air-conditioning apparatus and the method of assembling an outdoor unit of an air-conditioning apparatus according to embodiments of the present invention are configured as stated above and thus enable attachment of the upper soundproof material after connection of a compressor and a pipe to each other. Consequently, the attachment workability of the soundproof material in the outdoor unit of an air-conditioning apparatus can be improved and thus the efficiency of assembling of the outdoor unit of an air-conditioning apparatus can be enhanced while the performance of the soundproof material for reducing noise caused by the compressor is ensured.

DESCRIPTION OF EMBODIMENTS

Figure 1:
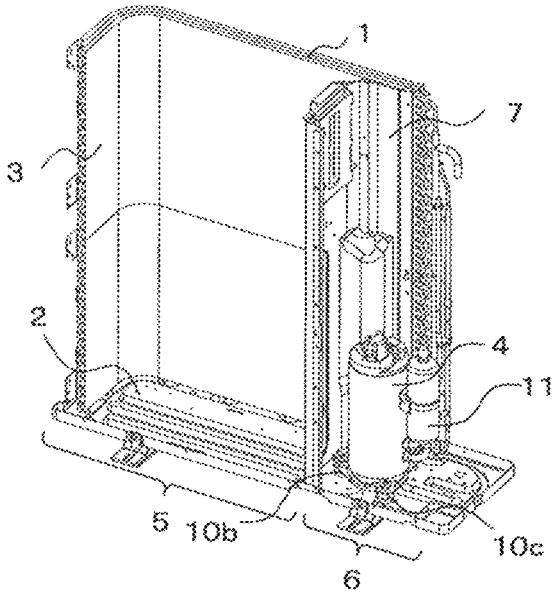
FIG. 1 is a perspective diagram illustrating an inner structure of an outdoor unit of an air-conditioning apparatus according to Embodiment 1 of the present invention.

Embodiments of the present invention will be described hereinafter with reference to the drawings. In each drawing, a device or a component provided with a reference signs that is the same as that of a certain device or a component represents a device identical or corresponding to the certain device or the component. This note is common through the entire description. Also, forms of components included in the entire description are mere examples and the present invention is not limited only to the statements in the description. In particular, combinations of components are not limited only to those in the embodiments and a component described in one embodiment can be employed for another embodiment. Furthermore, in a case where a plurality of devices of a same type that are, for example, distinguished by suffixes do not need to be specifically distinguished or specified, the devices may be described with the suffixes omitted. Also, in the drawings, a size ratio between the components may be different from actual one.

Embodiment 1

FIG. 1 is a perspective diagram illustrating an inner structure of an outdoor unit 1 of an air-conditioning apparatus of Embodiment 1 of the present invention. In FIG. 1, illustration of a decorative panel of a casing that covers the outdoor unit 1 of an air-conditioning apparatus, a propeller fan for sending air and some of components included in a refrigerant circuit is omitted. In the outdoor unit 1 of an air-conditioning apparatus, an outdoor heat exchanger 3 for heat exchange, a compressor 4 for compression and circulation of refrigerant, and a partition plate 7 for separating an air sending device compartment 5 and a mechanical compartment 6 are mounted on a bottom plate 2, which is a base on which components accommodated in the outdoor unit 1 of an air-conditioning apparatus are mounted. Also, a refrigerant separator 11 for separation of two-phase refrigerant is connected to the compressor 4. The refrigerant separator 11 is disposed lateral to the compressor 4. A lower face of the refrigerant separator 11 and a lateral face of a lower portion of the compressor 4 are connected via a pipe.

Figure 2:
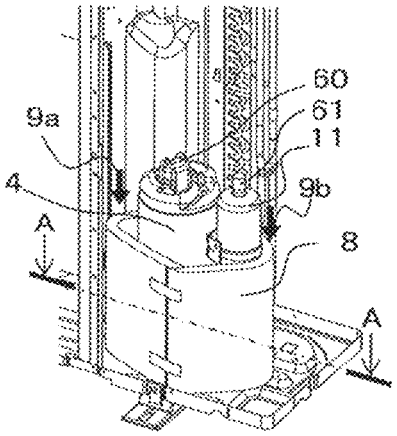
FIG. 2 is a perspective diagram illustrating a compressor in FIG. 1 with a lower soundproof material attached to a periphery of the compressor.
Figure 3:
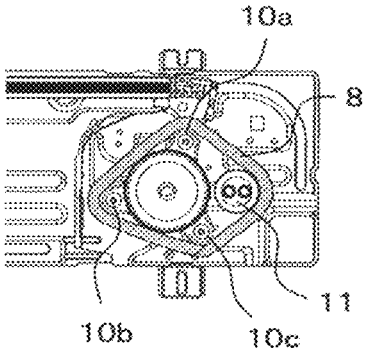
FIG. 3 is a diagram illustrating a cross-section along A-A in FIG. 2.

FIG. 2 is a perspective diagram illustrating a lower soundproof material 8 attached around the periphery of the compressor 4 in FIG. 1. FIG. 3 is a diagram illustrating a cross-section along A-A in FIG. 2. The A-A cross-section is a cross-section including a horizontal cross-section of three components of the lower soundproof material 8, the compressor 4, and the refrigerant separator 11. A conventional soundproof material is attached to the compressor 4 by inserting the soundproof material in the lateral direction after refrigerant circuit components are brazed to the compressor 4. However, in the outdoor unit 1 of an air-conditioning apparatus according to Embodiment 1, before the refrigerant circuit components are brazed to the compressor 4, the lower soundproof material 8 is attached to cover the compressor 4 and the refrigerant separator 11 from above the compressor 4, that is, in the direction of arrows 9*a* and 9*b* shown in FIG. 2. In other words, the lower soundproof material 8 is attached in such a manner that the compressor 4, the refrigerant separator 11, and compressor leg portions 10*a* to 10*c* are inserted in a space inside the lower soundproof material 8 having a tube-like shape. Here, the lower soundproof material 8 having a band-like shape is rolled into a tube-like shape and fixed in such a manner that opposite ends of the band shape face and are in contact with each other. Alternatively, the lower soundproof material 8 having a band-like shape may be rolled into a tube-like shape and fixed in such a manner that opposite ends of the lower soundproof material 8 in the band shape overlay on each other. Furthermore, as with the later-described upper soundproof material, the lower soundproof material 8 may be rolled into a tube-like shape and fixed by fastening hook-and-loop fastener hook portions 15*a* to 15*c* and hook-and-loop fastener loop portion 16*a* to 16*c* with each other. Note that the step of attaching the lower soundproof material 8 to the compressor 4 is referred to as "lower soundproof material attachment step."

As illustrated in FIG. 1, the compressor 4 is mounted on the bottom plate 2 by use of the compressor leg portions 10*a* to 10*c*. As the compressor 4 vibrates during operation, it is necessary to reduce transmission of the vibration from the bottom plate 2 to the entire casing. For reduction of transmission of vibration from the compressor 4 to the bottom plate 2, the compressor leg portions 10*a* to 10*c* have a vibration absorption structure. For reduction of leakage of noise generated from the compressor 4 to the outside, the lower soundproof material 8 needs to surround the lateral periphery of the lower portion of compressor 4 including areas in which the compressor leg portions 10*a* to 10*c* installed on the lower portion of the compressor 4 are disposed. As described above, the lower soundproof material 8 can be attached to the compressor 4 with no refrigerant circuit components connected to the compressor 4 and thus can correctly cover the compressor leg portions 10*a* to 10*c* for fixing the bottom plate 2 and the compressor 4 to each other, the compressor 4, and the refrigerant separator 11. Furthermore, whether or not the lower soundproof material 8 is correctly attached can be easily confirmed even for the compressor leg portion 10*a* positioned on the rear of the compressor 4 and other parts that cannot be easily visually confirmed after attachment of the refrigerant circuit components.

Figure 4:
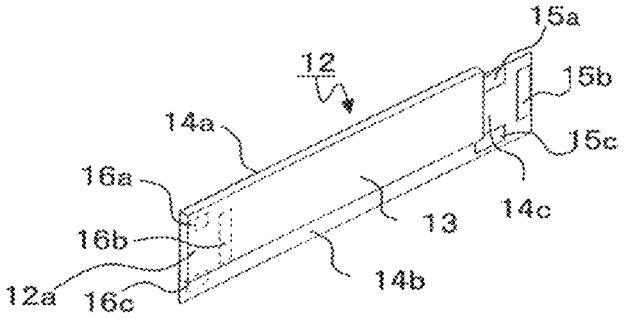
FIG. 4 is a perspective diagram illustrating an upper soundproof material to be attached to the outdoor unit of an air-conditioning apparatus according to Embodiment 1 of the present invention.

FIG. 4 is a perspective diagram illustrating an upper soundproof material 12 to be attached to the outdoor unit 1 of an air-conditioning apparatus of Embodiment 1 of the present invention. The upper soundproof material 12 includes an inner part 13 to be positioned to face a position in which the compressor 4, the compressor leg portions 10*a* to 10*c*, and the refrigerant separator 11 are disposed. The upper soundproof material 12 further includes an outer part 14*a* disposed on the outer side of the inner part 13. In other words, the upper soundproof material 12 is formed by overlaying the inner part 13 and the outer part 14*a* on each other. In Embodiment 1, the inner part 13 is made of, for example, felt. Consequently, the inner part 13 can absorb noise released from the compressor 4. Also, in Embodiment 1, the outer part 14*a* is made of, for example, rubber. Consequently, the outer part 14*a* can reduce release, to the outside, of noise released from the compressor 4 and failed to be absorbed by the inner part 13.

The outer part 14*a* includes an outer part extension portion 14*c*, which is a part that is longitudinally longer than the inner part 13. The outer part 14*a* also includes a lower extension portion 14*b* that is larger in width than that of the inner part 13 and projects farther than a lower end portion of the inner part 13. Furthermore, the hook-and-loop fastener hook portions 15*a* to 15*c* are attached to a face on which the inner part 13 is positioned, of the outer part extension portion 14*c*. Also, hook-and-loop fastener loop portions 16*a* to 16*c* are provided at an end portion opposite to an end portion with the outer part extension portion 14*c* provided, of the outer part 14*a*. The hook-and-loop fastener loop portions 16*a* to 16*c* are attached to an external face of the outer part 14*a*, that is, a face opposite to the face with the inner part 13 positioned. The hook-and-loop fastener hook portions 15*a* to 15*c* and the hook-and-loop fastener loop portions 16*a* to 16*c* can be fastened with each other and separated from each other, which enables the upper soundproof material 12 to be kept in a tube-like shape by overlaying opposite ends in the longitudinal direction of the upper soundproof material 12 on each other. The above-described structure enables the upper soundproof material 12 to be fixed when the upper soundproof material 12 is attached to the compressor 4. Note that the hook-and-loop fastener hook portions 15*a* to 15*c* and the hook-and-loop fastener loop portions 16*a* to 16*c* in Embodiment 1 correspond to "fixing part" in the present invention. Also, In Embodiment 1, the upper soundproof material 12 is fixed in a tube-like shape by fastening the hook-and-loop fastener hook portions 15*a* to 15*c* and the hook-and-loop fastener loop portion 16*a* to 16*c* with each other, but the upper soundproof material 12 may be fixed in a tube-like shape in such a manner that faces with no hook-and-loop fastener are fastened with each other.

Figure 5:
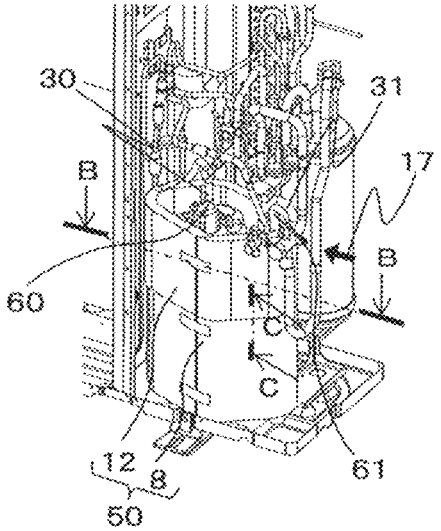
FIG. 5 is a perspective diagram illustrating the upper soundproof material in FIG. 4 attached to the compressor.
Figure 6:
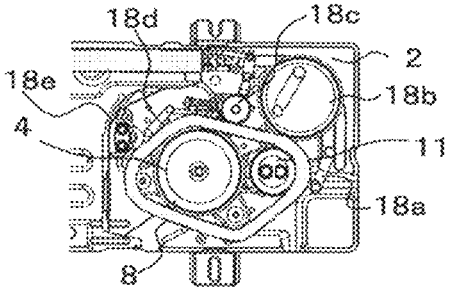
FIG. 6 is a diagram illustrating a cross-section along B-B in FIG. 5.

FIG. 5 is a perspective diagram illustrating the compressor 4 with the upper soundproof material 12 in FIG. 4 attached to the compressor 4. FIG. 6 is a diagram illustrating a cross-section along B-B in FIG. 5. The upper soundproof material 12 surrounds lateral faces of parts of the compressor 4 and the refrigerant separator 11 that are positioned higher than the parts of the compressor 4 and the refrigerant separator 11 surrounded by the lower soundproof material 8. For prevention of burning of the upper soundproof material 12 due to brazing of a pipe 30 and a pipe 31 to be connected to a pipe connection portion 60 of the compressor 4 and a pipe connection portion 61 of the refrigerant separator 11, respectively, the upper soundproof material 12 is attached after attachment of refrigerant circuit components 18*a* to 18*e* and other components to the outdoor unit 1 of an air-conditioning apparatus. Note that the step of attaching the pipe 30 to the compressor 4 and the step of attaching the pipe 31 to the refrigerant separator 11 are collectively referred to as "pipe joining step." The attachment of the pipe 30 and the pipe 31 is not limited to attachment by joining using brazing, and may be, for example, attachment through a joining method such as welding.

The upper soundproof material 12 is inserted in a lateral direction 17 onto a lateral face of the compressor 4 and attached to surround the periphery of the compressor 4 and the refrigerant separator 11. The upper soundproof material 12 is passed through a gap between the compressor 4 and the refrigerant separator 11, and the refrigerant circuit components 18*a* to 18*e*, which are disposed around the compressor 4 and the refrigerant separator 11, and disposed to surround the periphery of the compressor 4 and the refrigerant separator 11 and then fixed by fastening the hook-and-loop fastener hook portions 15*a* to 15*c* of the outer part extension portion 14*c* and the hook-and-loop fastener loop portions 16*a* to 16*c* disposed on the external face of the outer part 14*a* with each other.

Figure 7:
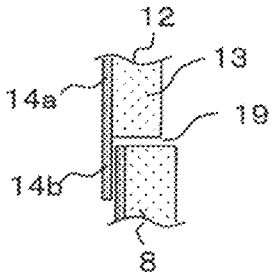
FIG. 7 is a diagram illustrating a cross-section along C-C in FIG. 5 of the part in which the upper soundproof material and the lower soundproof material face and are in contact with each other.

FIG. 7 is a diagram illustrating a cross-section along C-C in FIG. 5 of the part in which the upper soundproof material 12 and the lower soundproof material 8 face and are in contact with each other. The C-C cross-section is a vertical cross-section of the outdoor unit 1 of an air-conditioning apparatus and includes the part in which a lower end of the upper soundproof material 12 and an upper end of the lower soundproof material 8 face and are in contact with each other. An upper end portion of the lower soundproof material 8 and a lower end portion of the upper soundproof material 12 face and are in contact with each other and a gap 19 may be opened at the part in which the upper end portion of the lower soundproof material 8 and the lower end portion of the upper soundproof material 12 face and are in contact with each other. Consequently, during operation of the compressor 4, noise may leak from the gap 19. To solve the problem, the gap 19 in the part in which the upper end portion of the lower soundproof material 8 and the lower end portion of the upper soundproof material 12 face and are in contact with each other is covered by the lower extension portion 14*b* of the upper soundproof material 12. The above configuration allows an external face of the gap 19 opened between the upper end portion of the lower soundproof material 8 and the lower end portion of the upper soundproof material 12 to be covered by the lower extension portion 14*b* of the outer part 14*a* to close the gap 19 and thereby enables soundproof effect enhancement.

Figure 8:
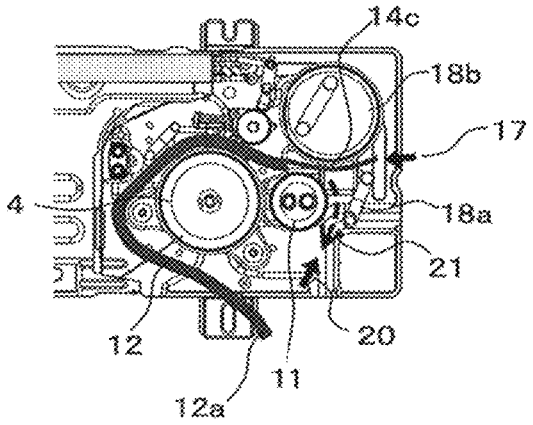
FIG. 8 is a cross-sectional diagram illustrating a method for attaching the upper soundproof material in FIG. 4.

FIG. 8 is a cross-sectional diagram illustrating a method for attaching the upper soundproof material 12 in FIG. 4. The upper soundproof material 12 needs to cover the refrigerant separator 11 connected to the lower portion of the compressor 4 via a pipe in addition to the compressor 4. Consequently, the upper soundproof material 12 is desirably inserted a space between the refrigerant separator 11 and the refrigerant circuit component 18*a*, to be attached. More specifically, the upper soundproof material 12 is inserted in a vertical direction 20 illustrated FIG. 8. However, in a model with a narrow space between the refrigerant separator 11 and the refrigerant circuit component 18*a* and a narrow space between the refrigerant separator 11 and the refrigerant circuit component 18*b*, it may be difficult to insert the upper soundproof material 12 in the vertical direction 20 for attachment of the upper soundproof 12. For an a conventional soundproof material, an end portion 12*a* of the upper soundproof material 12 is inserted in the vertical direction 20 illustrated in FIG. 8 and the soundproof material is passed through a space between the refrigerant circuit component 18*a* and the refrigerant separator 11 and a space between the refrigerant circuit component 18*b* and the refrigerant separator 11 and is attached to surround the periphery of the compressor 4. However, the space between the refrigerant circuit component 18*b* and the refrigerant separator 11 extends substantially orthogonal to the direction of the arrow indicating the vertical direction 20 and the upper soundproof material 12 inserted from the vertical direction 20 cannot be easily passed through the space, requiring more time for assembly.

In Embodiment 1, the upper soundproof material 12 is inserted the space between the refrigerant circuit components 18*a* and 18*b* in the lateral direction 17 and the end portion 12*a* opposite to the outer part extension portion 14*c* is drawn out to the front face on which the compressor 4 is exposed, that is, the lower end in FIG. 8. Subsequently, the outer part extension portion 14*c* can be passed the space between the refrigerant separator 11 and the refrigerant circuit component 18*a* and drawn out in the direction of the dashed arrow 21 shown in FIG. 8 for attachment. The provision of the relatively-thin and stiff outer part extension portion 14*c* in the upper soundproof material 12 enables the outer part extension portion 14*c* to be drawn out through a narrow space. Consequently, the attachment workability of the upper soundproof material 12 in a narrow space, which have conventionally been difficult, can be enhanced. Note that the above-described step of attaching the upper soundproof material 12 in Embodiment 1 is referred to as "upper soundproof material attachment step."

Effects of Embodiment 1

(1) The outdoor unit 1 of an air-conditioning apparatus according to Embodiment 1 includes the compressor 4 installed inside the casing and the soundproof material 50 covering at least the compressor 4. The soundproof material 50 includes the lower soundproof material 8 covering at least lateral faces of the lower portion of the compressor 4 and the compressor leg portions 10*a* to 10*c* and the upper soundproof material 12 covering at least a lateral face of the upper portion of the compressor 4.

The above configuration of the outdoor unit 1 of an air-conditioning apparatus enables attaching the upper soundproof material 12 after brazing the compressor 4 and the pipe 30 to each other. Consequently, the upper soundproof material 12 can be prevented from being burned by brazing. Also, the lower soundproof material 8 can be attached to cover from above before brazing of the compressor 4 and the pipe 30 to each other, which provides the effect of enabling correctly covering the compressor leg portions 10*a* to 10*c*. Also, the lower soundproof material 8 can be attached with the refrigerant circuit components 18*a* to 18*d* not installed around the compressor 4, which provides the effect of easily visually confirming whether the compressor leg portions 10*a* to 10*c* are covered by the lower soundproof material 8. As described above, the attachment workability of the soundproof material 50 in the outdoor unit 1 of an air-conditioning apparatus can be improved and thus the assembling efficiency can be enhanced while the performance of the soundproof material for reducing noise caused by the compressor is ensured.

(2) In the outdoor unit 1 of an air-conditioning apparatus according to Embodiment 1, each of the lower soundproof material 8 and the upper soundproof material 12 is formed by overlaying an inner part 13 having a band-like shape and an outer part 14*a* having a band-like shape on each other. The inner part 13 is positioned to face the compressor 4 and the outer part 14*a* is positioned on the outer side of the inner part 13.

The above configuration enables the soundproof material 50 to cover the lateral periphery of the compressor 4 and reduce noise from the compressor 4 by a dual-layer structure of the inner part 13 and the outer part 14*a*.

(3) In the outdoor unit 1 of an air-conditioning apparatus according to Embodiment 1, of the upper soundproof material 12, the outer part 14*a* having a band-like shape includes an outer part extension portion 14*c* projecting farther than the longitudinal end portion of the inner part 13. The outer part extension portion 14*c* includes the hook-and-loop fastener hook portions 15*a* to 15*a* Note that the hook-and-loop fastener hook portions 15*a* to 15*c* correspond to the "fixing part" in the present invention. Also, in Embodiment 1, the hook-and-loop fastener hook portions 15*a* to 15*c* are provided on the outer part extension portion 14*c* but may be the hook-and-loop fastener loop portions 16*a* to 16*c*.

The above configuration enables installing the upper soundproof material 12 in such a manner that the upper soundproof material 12 surrounds the lateral periphery of the compressor 4, the opposite ends of the inner part 13 having a band-like shape face and are in contact with each other, and then fastening the hook-and-loop fastener hook portions 15*a* to 15*c* provided on the outer part extension portion 14*c* projecting farther than one end portion of the inner part 13 and the hook-and-loop fastener loop portion 16*a* to 16*c* provided on a face of a part of the outer part 14*a*, the part being located on the outer side of the other end portion of the inner part 13, with each other to keep the upper soundproof material 12 in a tube-like shape. Also, the outer part extension portion 14*c* covers an external face of a gap opened the part in which the opposite ends of the inner part 13 face and are in contact with each other and thus can reduce noise leaking from the gap. Furthermore, the upper soundproof material 12 is inserted between the refrigerant circuit components 18*a* and 18*b* provided in the periphery of the compressor 4 in the lateral direction 17, the end portion 12*a* opposite to the outer part extension portion 14*c* is drawn out to the front face, and then the outer part extension portion 14*c* can be passed the space between the refrigerant separator 11 and the refrigerant circuit component 18*a* and drawn out. In other words, the outer part extension portion 14*c* of the upper soundproof material 12 enables improvement in attachment workability of a soundproof material in a narrow space, which have conventionally been difficult.

(4) In the outdoor unit 1 of an air-conditioning apparatus according to Embodiment 1, the lower end portion of the upper soundproof material 12 faces and is in contact with the upper end portion of the lower soundproof material 8.

(5) Also, in the outdoor unit 1 of an air-conditioning apparatus according to Embodiment 1, the upper soundproof material 12 also includes the lower extension portion 14*b* projecting from an end portion in a direction orthogonal to the longitudinal direction of the outer part 14*a*. The lower extension portion 14*b* covers an external face of the upper end portion of the lower soundproof material 8.

The above configuration enables the soundproof material 50, configured by combining the upper soundproof material 12 and the lower soundproof material 8, to reduce noise generated from the compressor 4 as in a case where the soundproof material 50 is configured by a single part. In particular, the external face of the gap 19 opened in the part in which the lower end portion of the upper soundproof material 12 and the upper end portion of the lower soundproof material 8 face and are in contact with each other can be covered by the lower extension portion 14*b* of the outer part 14*a*, enabling reduction of noise leaking from the gap 19.

(6) In the outdoor unit 1 of an air-conditioning apparatus according to Embodiment 1, the upper end portion of the lower soundproof material 8 is positioned lower than the pipe connection portion 60 of the compressor 4.

In the above configuration, when the work of connecting the compressor 4 and the pipe 30 is performed, as the upper end portion of the lower soundproof material 8 is located at a position away from the site of the connection work, the upper end portion of the lower soundproof material 8 is prevented from, for example, being burned by the connection work such as brazing. Also, the connection work is easy and the efficiency of the work is enhanced.

(7) In the outdoor unit 1 of an air-conditioning apparatus according to Embodiment 1, the soundproof material 50 covers lateral faces of the compressor 4 and the refrigerant separator 11.

In the outdoor unit 1 of an air-conditioning apparatus, the above configuration enables the periphery of the entire compressor 4 to be covered by the soundproof material 50 and the gap from which noise leaks is reduced. Also, the work of connecting the refrigerant separator 11 to the compressor 4 can be performed before attachment of the soundproof material 50, which prevents the soundproof material 50 from being damaged by the connection work.

(8) A method for assembling the outdoor unit 1 of an air-conditioning apparatus according to Embodiment 1 includes the lower soundproof material attachment step of surrounding the periphery of the lower portion of the compressor 4 installed inside the casing by the lower soundproof material 8 and fixing the lower soundproof material 8, the pipe joining step of joining the pipe connection portion 60 positioned at the upper portion of the compressor 4 and the pipe 30 included in the refrigerant circuit, and the upper soundproof material attachment step of surrounding the periphery of the upper portion of the compressor 4 by the upper soundproof material 12 and fixing the upper soundproof material 12. The pipe joining step is performed after the soundproof material attachment step, and the upper soundproof material attachment step is performed after the pipe joining step.

As in (1) above, with the above method configuration, the attachment workability of the soundproof material 50 in the outdoor unit 1 of an air-conditioning apparatus can be improved and thus the assembling efficiency can be enhanced while the performance of the soundproof material 50 for reducing noise caused by the compressor is ensured.

REFERENCE SIGNS LIST

1 outdoor unit 2 bottom plate 3 outdoor heat exchanger 4 compressor 5 air sending device compartment 6 mechanical compartment 7 partition plate 8 lower soundproof material 9*a* arrow 9*b* arrow 10*a* compressor leg portion 10*b* compressor leg portion 10*c* compressor leg portion 11 refrigerant separator 12 upper soundproof material 12*a* end portion 13 inner part 14*a* outer part 14*b* lower extension portion

14*c* outer part extension portion 15*a* hook-and-loop fastener hook portion 15*b* hook-and-loop fastener hook portion 15*c* hook-and-loop fastener hook portion 16*a* hook-and-loop fastener loop portion 16*b* hook-and-loop fastener loop portion 16*c* hook-and-loop fastener loop portion 17 lateral direction 18*a* refrigerant circuit component 18*b* refrigerant circuit component 18*c* refrigerant circuit component 18*d* refrigerant circuit component 18*e* refrigerant circuit component 19 gap 20 vertical direction

21 dashed arrow 30 pipe 31 pipe 50 soundproof material 60 pipe connection portion 61 pipe connection portion.

The invention claimed is:

1. An outdoor unit of an air-conditioning apparatus, the outdoor unit comprising:

a compressor installed inside a casing; and a soundproof material covering at least the compressor, the soundproof material including a lower soundproof material surrounding a lateral periphery of a lower portion of the compressor, and an upper soundproof material surrounding a lateral periphery of an upper portion of the compressor, a lower end portion of the upper soundproof material facing and being in contact with an upper end portion of the lower soundproof material, the upper soundproof material being formed by overlaying an inner part having a band-like shape and an outer part having a band-like shape on each other, the upper soundproof material including a lower extension portion at which the outer part projects from the lower end portion of the upper soundproof material, the lower extension portion covering an external face of the upper end portion of the lower soundproof material, the lower extension portion not covering a lateral periphery of an external face of a lower end portion of the lower soundproof material.

2. The outdoor unit of an air-conditioning apparatus of claim 1, wherein the soundproof material surrounds a lateral face of the compressor and a lateral face of a refrigerant separator connected to the lateral face of the compressor.

3. The outdoor unit of an air-conditioning apparatus of claim 1, wherein the lower soundproof material is formed by overlaying an inner part having a band-like shape and an outer part having a band-like shape on each other, the inner part faces a position in which the compressor is disposed, and the outer part is positioned on an outer side of the inner part.

4. The outdoor unit of an air-conditioning apparatus of claim 3, wherein the soundproof material surrounds a lateral face of the compressor and a lateral face of a refrigerant separator connected to the lateral face of the compressor.

5. The outdoor unit of an air-conditioning apparatus of claim 3, wherein the outer part of the upper soundproof material includes an outer part extension portion projecting farther than a longitudinal end portion of the inner part, and the outer part extension portion includes a fixing part for joining faces of the upper soundproof material to each other.

6. The outdoor unit of an air-conditioning apparatus of claim 5, wherein the soundproof material surrounds a lateral face of the compressor and a lateral face of a refrigerant separator connected to the lateral face of the compressor.

7. The outdoor unit of an air-conditioning apparatus of claim 5, wherein the upper end portion of the lower soundproof material is positioned lower than a pipe connection portion positioned at an upper portion of the compressor.

8. The outdoor unit of an air-conditioning apparatus of claim 7, wherein the soundproof material surrounds a lateral face of the compressor and a lateral face of a refrigerant separator connected to the lateral face of the compressor.

9. A method of assembling an outdoor unit of an air-conditioning apparatus, the method comprising:

a lower soundproof material attachment step of surrounding a periphery of a lower portion of a compressor installed inside a casing by a lower soundproof material and fixing the lower soundproof material;

a pipe joining step of joining a pipe connection portion positioned at an upper portion of the compressor and a pipe included in a refrigerant circuit; and an upper soundproof material attachment step of surrounding a periphery of the upper portion of the compressor by an upper soundproof material and fixing the upper soundproof material, the pipe joining step being performed after the lower soundproof material attachment step, the upper soundproof material attachment step being performed after the pipe joining step.

10. The method according to claim 9, wherein the upper soundproof material includes a lower extension portion, and the lower soundproof material includes a lower end portion, and the upper soundproof material attachment step further includes:

the lower extension portion not covering a lateral periphery of an external face of the lower end portion.

11. The method according to claim 9, wherein the lower soundproof material attachment step further includes:

surrounding a lateral face of a refrigerant separator connected to a lateral face of the compressor with the lower soundproof material, and the upper soundproof material attachment step further includes:

surrounding a lateral face of a refrigerant separator connected to a lateral face of the compressor with the upper soundproof material.

12. The method according to claim 9, wherein the lower soundproof material is formed by overlaying an inner part having a band-like shape and an outer part having a band-like shape on each other, the inner part faces a position in which the compressor is disposed, and the outer part is positioned on an outer side of the inner part.

13. The method according to claim 12, wherein the lower soundproof material attachment step further includes:

surrounding a lateral face of a refrigerant separator connected to a lateral face of the compressor with the lower soundproof material, and the upper soundproof material attachment step further includes:

surrounding a lateral face of a refrigerant separator connected to a lateral face of the compressor with the upper soundproof material.

14. The method according to claim 9, wherein the upper soundproof material is formed by overlaying an inner part having a band-like shape and an outer part having a band-like shape on each other, the outer part of the upper soundproof material includes an outer part extension portion projecting farther than a longitudinal end portion of the inner part, and the outer part extension portion includes a fixing part for joining faces of the upper soundproof material to each other.

15. The method according to claim 14, wherein the lower soundproof material attachment step further includes:

surrounding a lateral face of a refrigerant separator connected to a lateral face of the compressor with the lower soundproof material, and the upper soundproof material attachment step further includes:

surrounding a lateral face of a refrigerant separator connected to a lateral face of the compressor with the upper soundproof material.

16. The method according to claim 9, wherein an upper end portion of the lower soundproof material is positioned lower than a pipe connection portion positioned at an upper portion of the compressor.

17. The method according to claim 16, wherein the lower soundproof material attachment step further includes:

surrounding a lateral face of a refrigerant separator connected to a lateral face of the compressor with the lower soundproof material, and the upper soundproof material attachment step further includes:

surrounding a lateral face of a refrigerant separator connected to a lateral face of the compressor with the upper soundproof material.

* * * * *